US008055000B2

(12) United States Patent
Ludvigsen

(10) Patent No.: US 8,055,000 B2
(45) **Date of Patent: *Nov. 8, 2011**

(54) HEARING AID WITH SUDDEN SOUND ALERT

(75) Inventor: Carl Ludvigsen, Valby (DK)

(73) Assignee: Widex A/S, Lynge (DK)

( * ) Notice: Subject to any disclaimer, the term of this patent is extended or adjusted under 35 U.S.C. 154(b) by 1179 days.

This patent is subject to a terminal disclaimer.

(21) Appl. No.: 11/653,976

(22) Filed: Jan. 17, 2007

(65) Prior Publication Data

US 2007/0116310 A1 May 24, 2007

Related U.S. Application Data

(60) Division of application No. 10/752,579, filed on Jan. 8, 2004, now Pat. No. 7,181,031, which is a continuation-in-part of application No. PCT/DK02/00465, filed on Jul. 4, 2002, which is a continuation-in-part of application No. 09/899,990, filed on Jul. 9, 2001, now abandoned.

(51) Int. Cl.
*H04R 25/00* (2006.01)

(52) U.S. Cl. ..... 381/312; 381/321; 381/94.1

(58) Field of Classification Search ..... 381/23.1, 381/57, 60, 94.1, 94.2, 94.3, 98, 106, 107, 381/312, 314, 317, 320, 321

See application file for complete search history.

(56) References Cited

U.S. PATENT DOCUMENTS 4,204,260 A 5/1980 Nysen
4,531,229 A 7/1985 Coulter
4,630,302 A 12/1986 Kryter
4,718,099 A 1/1988 Hotvet
4,813,417 A 3/1989 Soli et al.
5,144,675 A 9/1992 Killion et al.
5,165,017 A 11/1992 Eddington et al.
5,271,397 A 12/1993 Seligman et al.
5,402,498 A 3/1995 Waller, Jr.

(Continued)

FOREIGN PATENT DOCUMENTS

DE 42 28 934 A1 1/1993

(Continued)

OTHER PUBLICATIONS

Brian C.J. Moore et al., "A comparison of four methods of implementing automatic gain control (AGC) in hearing aids", British Journal of Audiology, 1998, pp. 93-104.

(Continued)

*Primary Examiner* — Huyen D. Le
(74) *Attorney, Agent, or Firm* — Sughrue Mion, PLLC

(57) ABSTRACT

A multichannel hearing aid (20) comprises at least one frequency channel having a compressor (38) with a compression threshold at an output level below the hearing threshold and an attack time above 0.5 seconds whereby hearing of a sudden sound in a stationary sound environment is facilitated. With this compressor, the amplification of low signal levels may be increased compared to the prior art, as the compressor kicks in to generally suppress steady noises. The gain may generally be increased as high as feasible in view of the microphone baseline noise, which should preferably be kept below the hearing threshold. Thus the user of the hearing aid will generally have the option of a higher gain of low level sounds than generally feasible with prior art hearing aids.

3 Claims, 5 Drawing Sheets

U.S. PATENT DOCUMENTS

| | | | | |
|---|---|---|---|---|
| 5,483,617 | A | 1/1996 | Patterson et al. | |
| 5,687,241 | A | 11/1997 | Ludvigsen | |
| 5,832,097 | A | 11/1998 | Armstrong et al. | |
| 6,285,767 | B1 | 9/2001 | Klayman | |
| 6,879,692 | B2 * | 4/2005 | Nielsen et al. | 381/60 |
| 7,031,484 | B2 * | 4/2006 | Ludvigsen | 381/316 |
| 7,181,031 | B2 * | 2/2007 | Ludvigsen | 381/312 |

FOREIGN PATENT DOCUMENTS

| | | | |
|---|---|---|---|
| EP | 0 732 036 | B1 | 5/1997 |
| GB | 2 192 511 | A | 1/1988 |
| WO | WO 96/35314 | | 11/1996 |
| WO | WO 97/11572 | | 3/1997 |
| WO | 99/34642 | | 7/1999 |

OTHER PUBLICATIONS

"Appareils de correction auditive" (Hearing aids Part 2: Hearing Aids with automatic gain control circuits): Commission Electotechnique Internationale Norme De La Cei, 1983.

* cited by examiner

HEARING AID WITH SUDDEN SOUND ALERT

CROSS REFERENCE TO RELATED APPLICATIONS

The present application is a divisional application of U.S. application Ser. No. 10/752,579, filed Jan. 8, 2004 now U.S. Pat. No. 7,181,031. U.S. application Ser. No. 10/752,579 is a continuation-in-part of application Ser. No. PCT/DK02/00465, filed in Denmark on Jul. 4, 2002, and a continuation-in-part of U.S. application Ser. No. 09/899,990, filed Jul. 9, 2001, now abandoned. The contents of all of the above-mentioned applications are incorporated hereinto by reference.

BACKGROUND OF THE INVENTION

1. Field of the Invention

The present invention relates to methods of processing sound signals in hearing aids. The invention more specifically relates to a method of processing sound in a hearing aid with a compressor that is active at very low sound levels. The invention, still more specifically, relates to a method of processing sound in a hearing aid that alerts the user of the occurrence of a sudden sound in a stationary sound environment.

2. The Prior Art

As used in this context, a hearing aid is understood as generally comprising a device with an input transducer for transforming an acoustic input signal into a first electrical signal, a signal processor for generating a second electrical signal based on the first electrical signal, an output transducer for conversion of the second signal into sound, and a battery for supplying energy to the signal processor.

Typically, a hearing aid has a housing holding the input and the output transducer, the battery and the signal processor. The housing is adapted to be worn, i.e. behind the ear, in the ear, or in the ear canal, and the output of the output transducer is led to the eardrum in a way that is well-known in the art of hearing aids. The processor will generally be adapted for processing the electric signal in order that the resulting acoustic output signal compensates a hearing deficiency of a user.

U.S. Pat. No. 4,777,474 provides an alarm system for the hearing impaired, comprising a base station radio transmitter adapted to transmit, upon detection of an alarm state, a signal to a portable unit. The portable unit includes all parts of an ordinary hearing aid together with a radio receiver to receive the signal transmitted by the base station.

WO 99/34642 discloses a hearing aid with an automatic gain control, effected by detecting an input sound level and/or an output sound level and adapting the output sound level supplied by the hearing aid in response to the detected sound level by controlling the gain of the hearing aid towards an actual desired value of the output sound level. The gain control is effected at increases and decreases, respectively, of the input sound level by adjusting the gain towards the actual desired value with an attack time and a release time, respectively, which are adjusted in response to the detected sound level to a relatively short duration providing fast gain adjustment at high input and/or output sound levels and to a relatively long duration providing slow gain adjustment at low input and/or output sound levels.

It is well known in the art to provide a hearing aid having a compressor with a characteristic that has two linear segments that are interconnected at a knee-point. The knee-point is typically placed at 50 dB SPL input level, close to the level of normal speech in order to allow a high level of amplification of speech. Below the knee point, the linear segment has substantially no compression, i.e. the gain is a constant gain adapted for compensating the hearing loss at low input signal levels. Above the knee point, the segment has a compression ratio above 1, typically 2:1, for compensating for recruitment. Recruitment is a sensorineural hearing loss whereby loudness increases rapidly with increased sound pressure just above the hearing threshold and increases normally at high sound pressures.

Many hearing aid users being situated in a stable sound environment desire to be able to hear a faint, sudden change in the sound environment, such as a sudden occurrence of a faint sound. For example, being at home, a hearing aid user may desire to be able to hear that a baby starts crying, or that water starts running, that somebody is present at the door, etc. The hearing aid user can increase the gain of the hearing aid to accomplish this but then the hearing aid user may be bothered by other sounds in the stationary sound environment, such as the sound of a ventilator, traffic noise, etc, that might then also be amplified to surpass the hearing threshold. The hearing threshold is the lowest sound level at which sound is perceptible.

SUMMARY OF THE INVENTION

It is an object of the present invention to provide a method of processing sound in a hearing aid that makes it possible for the user to hear a faint, sudden sound occurring in a stationary sound environment without being bothered with stationary sounds.

According to the present invention in a first aspect, the above-mentioned and other objects are fulfilled by the provision of a method of processing a sound signal in a hearing aid, comprising the steps of converting an acoustic signal into an electric signal, compressing the electric signal in a signal processor in at least one frequency channel according to a compression characteristic with an attack time above 0.5 seconds and a first and a second segment, said first and second segment being interconnected at a knee point at an output level below the hearing threshold, said first segment being situated below said knee point and having substantially no compression and said second segment being situated above said knee point and having a compression ratio greeted than 1.4 to produce a compressed signal, processing said compressed signal in said signal processor in order to produce a processor output signal adapted to compensate a user hearing deficiency, and converting the processor output signal into a sound signal.

According to the present invention in a second aspect, the above-mentioned and other objects are fulfilled by the provision of a method of processing a sound signal in a hearing aid, comprising the steps of converting an acoustic signal into an electric signal, feeding said electric signal into a signal processor and filtering, inside said processor, set electrical signal in a set of band pass filters to produce band pass filtered signal derivatives, compressing said band pass filtered signal derivatives in respective compressors connected to respective band pass filters to produce compressed signals, processing said compressed signals in said signal processor in order to produce a processor output signal suitable for compensating a users hearing deficiency, and converting the processor output signal into a sound signal.

The compressor is provided with a slow attack time, such as an attack time above 1 second, for example 2 seconds or more. The slow attack time permits transient sounds to be amplified without distortion to be clearly perceptible to the user.

The compressor may have a long release time, e.g. 10 times the attack time, for recovering the gain upon the vanishing of high-level sounds.

It is an important advantage of the present invention that the gain of the hearing aid is high at low signal levels while the microphone noise is still kept just below the hearing threshold. When a sudden sound occurs, the sound is amplified with the current large gain to provide an output signal above the hearing threshold so that the hearing aid user can hear it. If the sudden sound persists for a longer time than the attack time of the compressor, the gain will decrease with time, gradually lowering the hearing aid output signal as far as permitted by the compression ratio, and possibly causing the faint sudden sound to be no longer amplified above the hearing threshold. Thus the sudden sound can be heard by the hearing aid user for substantially the attack time of the compressor, which is a sufficient period for the user to be alerted by the sound.

According to an advantageous embodiment, the hearing aid signal processor may have a plurality of channels, preferably more than 6 channels, more preferred more than 8 channels, most preferred more than 10 channels, e.g. 15 channels.

According to another advantageous embodiment, the knee point is situated at 10 dB SPL input level. Typically, the knee-point is situated below 25 dB SPL input level, more often below 20 dB SPL input level, for example below 15 dB SPL. This allows for a maximum of gain at sound levels close to lowest level audible to people with normal hearing. The maximum of gain selected for a particular user will depend on his particular hearing deficiency and the fitting rule. Generally a complete compensation of the hearing deficiency is not feasible for reasons such as user comfort. The amount of faint sounds that may be amplified sufficiently to be audible to the user may vary according to the specific circumstances. However, sounds at 25 dB SPL input will generally not be amplified so much as to be audible to a hearing impaired person using a hearing aid tuned according to standard fitting rules.

Other advantageous embodiments of the invention appear from the dependent claims.

Still other objects of the present invention will become apparent to those skilled in the art from the following description wherein the invention will be explained in greater detail. By way of example, there is shown and described a preferred embodiment of the invention. As will be realized, the invention is capable of other different embodiments, and its several details are capable of modification in various, obvious aspects all without departing from the invention. Accordingly, the drawings and descriptions will be regarded as illustrative in nature and not as restrictive. In the drawing:

DETAILED DESCRIPTION OF PREFERRED EMBODIMENTS

Figure 1:
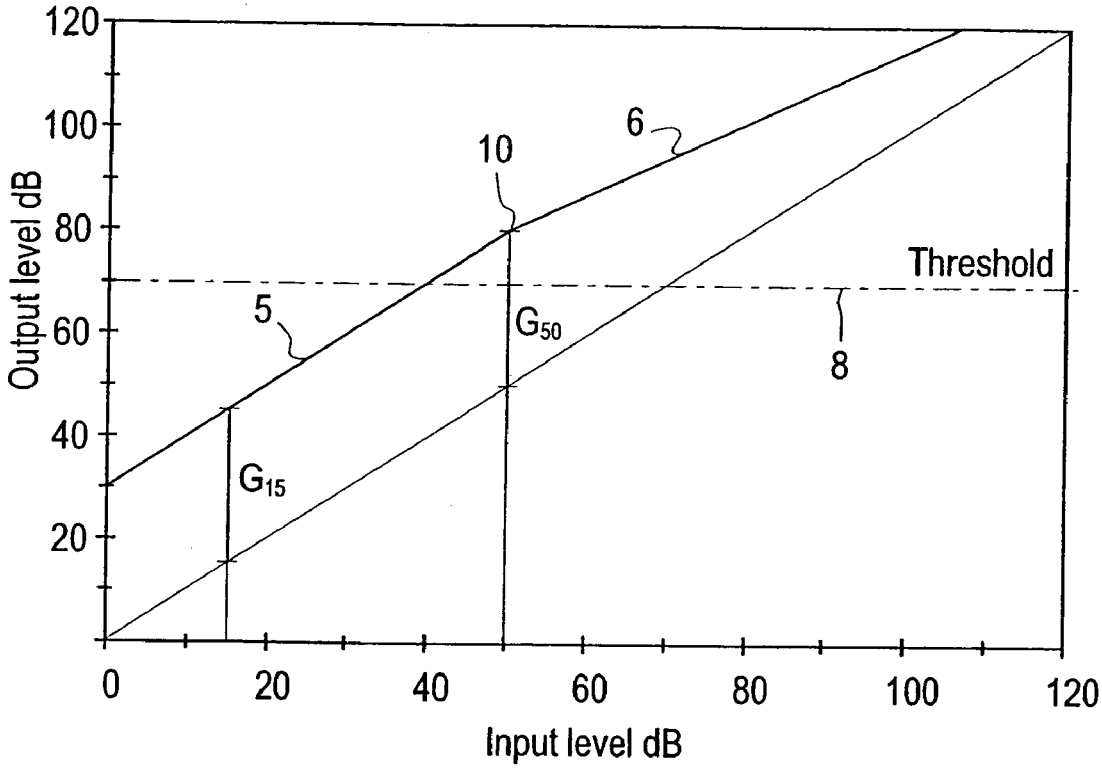
PRIOR ART Fig. 1
FIG. 1 shows a prior art compressor characteristic.

FIG. 1 shows a plot of a prior art compressor characteristic, i.e. a plot of the compressor output level as a function of the input level, both in SPL. This characteristic may be for a general compressor or it may be for one among a bank of narrow-band compressors in a hearing aid signal processor. The particular characteristic may depend on the fitting to a particular user. The example in the figure assumes the hearing aid has been tuned to compensate a particular hearing deficiency, as partially illustrated by the hearing threshold line at 70 dB. The fitting to other users may be suggested by those skilled in the art of hearing aid fitting.

The characteristic comprises two linear segments 5, 6, which are interconnected at a knee-point 10 (CT—Compression Threshold) typically positioned at 50 dB SPL input level. At sound levels below the knee point 10, as evidenced by the linear segment 5, there is substantially no compression, i.e. the gain is a constant gain, suitable for compensating the hearing loss at low input signal levels. In FIG. 1, this gain is 30 dB as illustrated at the line $G_{15}$ at 15 dB input level and identically 30 dB as illustrated at the line $G_{50}$ at 50 dB input level. Normal speech is about 50 dB input level. Above the knee point 10, as evidenced by the segment 6, there is a compression ratio above 1, typically 2:1, lowering the gain at high input levels as appropriate for compensating for recruitment. The compression ratio of a segment is equal to the reciprocal value of the slope of the segment. Given a low-end gain of 30 dB and a hearing threshold of 70 dB, input levels below 40 dB will not be audible to this hearing aid user.

In order to be able to hear a faint sudden change in the sound environment, such as a sudden occurrence of a faint sound, the hearing aid user can increase the gain of the hearing aid thereby displacing the characteristic shown in FIG. 1 upwardly in the direction of the y-axis. In that case, however, other faint sounds in the stationary sound environment, such as the sound of a ventilator, traffic noise, etc, will also be amplified, possibly to a level above the hearing threshold causing an annoyance or an uncomfortable disturbance of the user.

Figure 2:
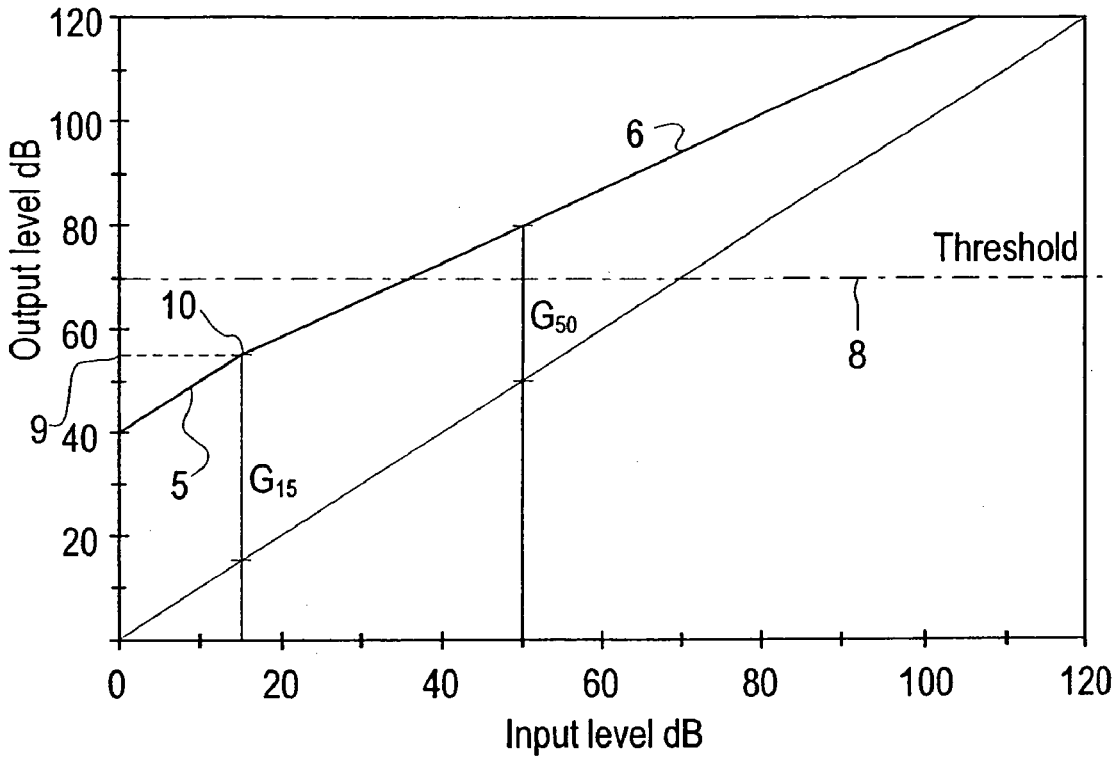
FIG. 2 shows a compressor characteristic according to the present invention.

FIG. 2 shows a compressor characteristic of a compressor according to the present invention. In FIG. 2, the segments 5, 6 correspond to the segments 5, 6 shown in FIG. 1. Preferably, segment 6 has a compression ratio that is greater than 1.4, and, more preferred, a compression ratio substantially equal to 2. Other values of the compression ratio may be used if appropriate. It is the gist of the present invention that the output level 9 at the knee-point or compression threshold is lower than the hearing threshold 8. In FIG. 2, the knee-point is situated at about 15 dB input level, i.e. in the low end of the range audible to people with normal hearing. The gain at the knee-point and below is about 40 dB as illustrated by $G_{15}$, drawn at 15 dB input level. Above the knee-point the gain rolls off governed by the compressor, reaching about 30 dB at 50 dB input level as illustrated by $G_{50}$. Thus the gain at normal speech level is similar to that illustrated in FIG. 1. On the other hand the gain is substantially higher at low signal levels than for the prior art compressor.

The hearing aid according to the present invention may have a microphone that generates a low level of microphone noise. The hearing aid signal processor may have a plurality of channels, preferably more than 6 channels, more preferred more than 8 channels, most preferred more than 10 channels, e.g. 15 channels. Since noise in each channel is substantially proportional to channel bandwidth, an increase in the number of channels leads to a reduction of the noise in each channel.

Thus, in spite of the increased gain, the noise in a channel is still maintained below the hearing threshold. In the present example, the knee point is situated at 15 dB SPL input level. Typically, the knee-level is situated below 25 dB SPL input level, more often below 20 dB SPL input level, for example below 15 dB SPL.

Figure 3:
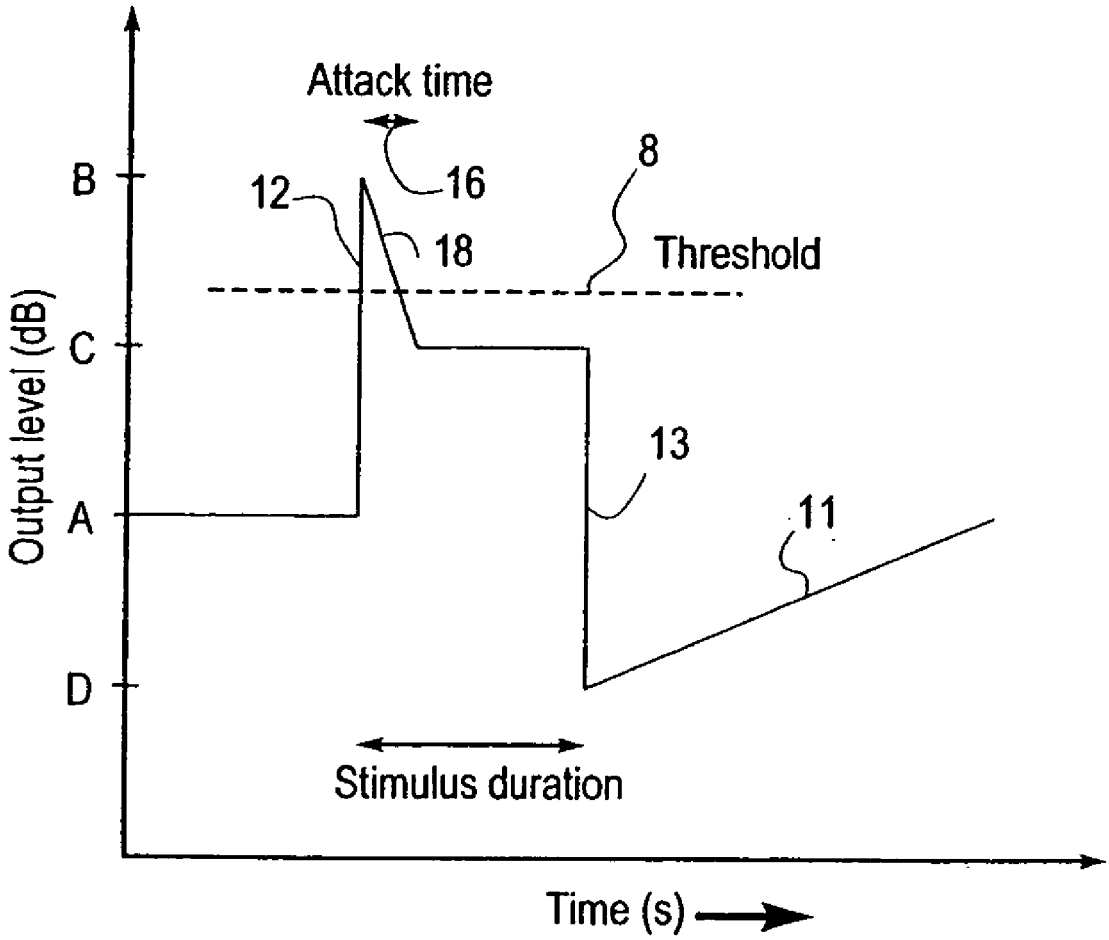
FIG. 3 illustrates amplification by a hearing aid according to the present invention of a sudden sound in a stationary sound environment.

FIG. 3 illustrates amplification by a hearing aid according to the present invention of a sudden sound in an otherwise steady sound background 11. The sudden sound is illustrated by a square wave pulse rising at 12 and disappearing at 13. The steady sound background is processed in the hearing aid to produce an output signal at the level A, below the hearing threshold. The compressor is provided with a slow attack time, such as 1 or 2 seconds. Transient signals are amplified linearly. When the sound pulse occurs at 12, the sound pulse is amplified with the current large gain in order to produce initially an output sound signal at level B. In the example, B exceeds the hearing threshold 14, signifying that the signal is indeed audible to the hearing aid user.

If the sound pulse persists for a longer time than the attack time 16 of the compressor, the compressor will kick in to decrease the gain over time 18 to gradually arrive at the output level C, below the threshold of hearing. Thus, depending on the magnitude of the signal, eventually the sudden sound may no longer be amplified above the hearing threshold 14. In the example, the sudden sound 13 can be heard by the hearing aid user for substantially the attack time 16 of the compressor, which is a sufficient period for the user to be alerted by the sound. Disappearance of the square wave sound pulse at 13 produces a downward step taking the output level to the point D. The compressor recovers from this new lower level only slowly. Gradually, according to the compressor release time, the gain grows to take the output level back to the initial level A.

Figure 5:
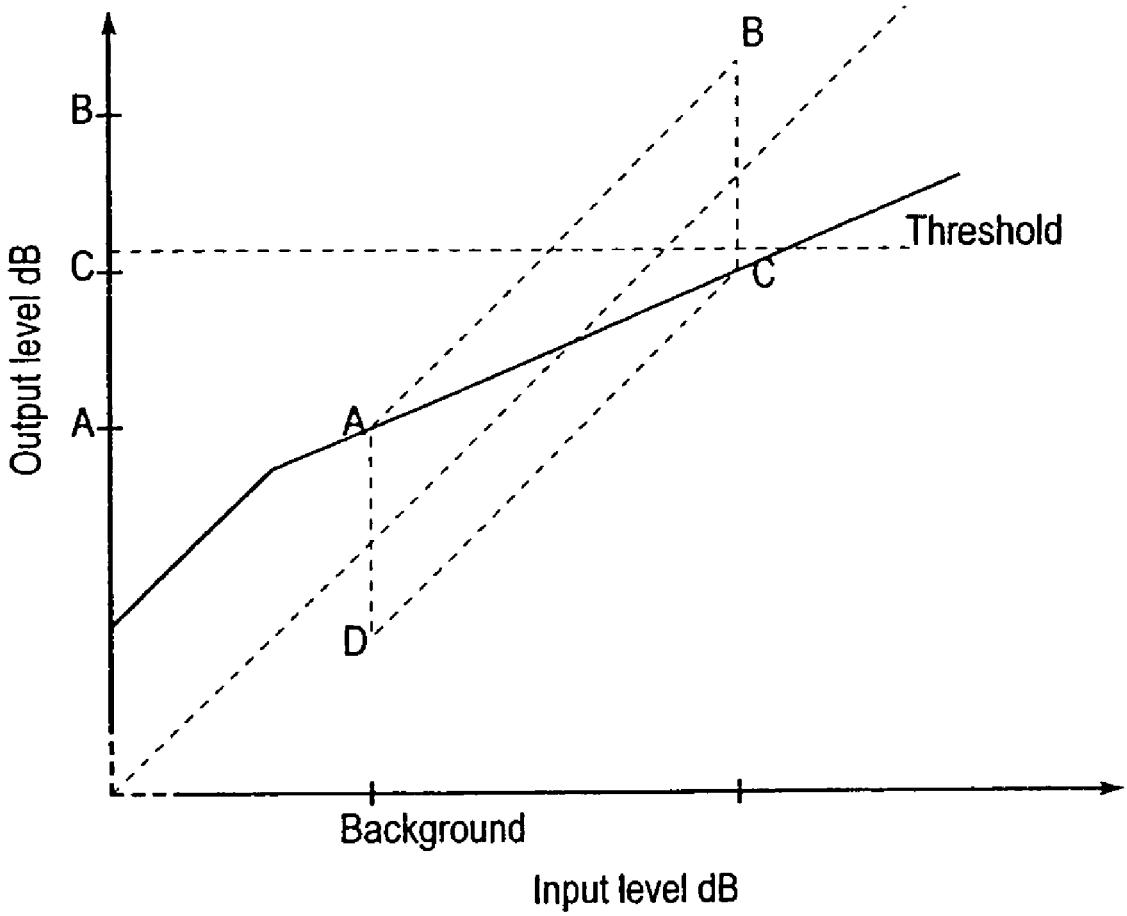
FIG. 5 is an enlarged view of a compressor characteristic according to the invention with illustration of the processing of a sound stimulus.

Reference is also made to FIG. 5 for a plot of the points A, B, C and D in the input-output diagram. This plot illustrates the points A and C on the compressor curve, which represent steady state situations, whereas the points B and D, which represent transient states, are defined by a respective starting point and by a step height (up or down).

Generally, it is assumed that the human ear has a time constant for loudness perception in the order of 0.2 to 0.3 seconds. This is the minimum duration required by a human ear for a full perception of the loudness of the signal. Shorter signals may also be perceived, however the loudness of shorter signals tends to be underestimated.

Figure 4:
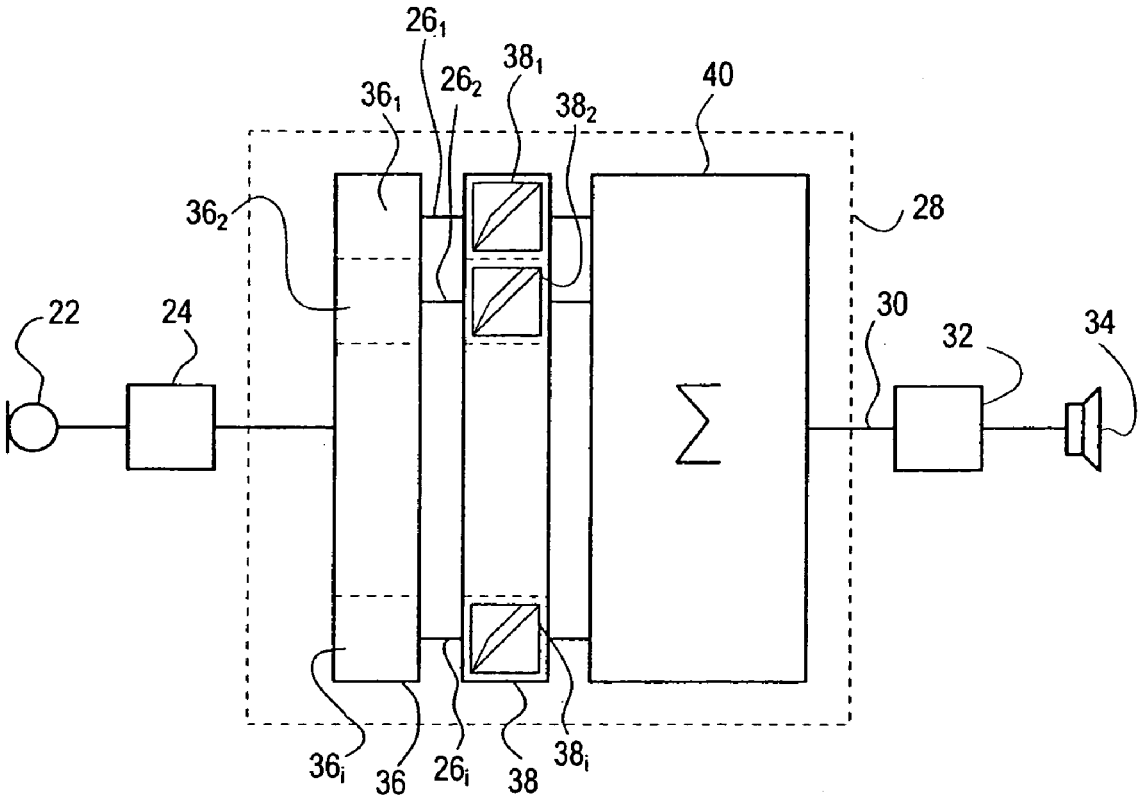
FIG. 4 shows a blocked diagram of a hearing aid according to the present invention.

FIG. 4 shows a schematic block diagram of a hearing aid 20 according to the present invention. It will be obvious for the person skilled in the art that the circuits indicated in FIG. 6 may be implemented using digital or analogue circuitry or any combination hereof. In the present embodiment, digital signal processing is employed and thus, the processor 28 consists of digital signal processing circuits. In the present embodiment, all the digital circuitry of the hearing aid 20 may be provided on a single digital signal-processing chip or, the circuitry may be distributed on a plurality of integrated circuit chips in another way.

In the hearing aid 20, a microphone 22 is provided for reception of a sound signal and conversion of the sound signal into a corresponding electrical signal representing the received sound signal. The hearing aid 20 may comprise a plurality of input transducers 22 with appropriate input stage processing for the purpose of added functionality, e.g. for providing a direction sensitive capability. The microphone 22 converts the sound signal into an analogue electric signal. The analogue electric signal is sampled and digitized by an A/D converter 24 into a digital signal 26 for digital signal processing in the hearing aid 20. The digital signal 26 is fed to a digital signal processor 28 for amplification of the microphone output signal 26 according to a desired frequency characteristic and compressor function to provide an output signal 30 suitable for compensating the hearing deficiency of the user. The output signal 30 is fed to a D/A converter 32 and further to an output transducer 34, i.e. a receiver 34, which converts the output signal 30 into an acoustic output signal.

The signal processor 28 comprises a first filter bank 36 with band pass filters $\mathbf{36}_i$ for dividing the electrical signal 26 into a set of band pass filtered first electrical signal derivatives $\mathbf{26}_1$, $\mathbf{26}_2, \ldots, \mathbf{26}_i$. Further, the signal processor 28 comprises a set 38 of compressors and offset amplifiers $\mathbf{38}_1, \mathbf{38}_2, \ldots, \mathbf{38}_i$ each of which is connected to a different band pass filter $\mathbf{36}_1$, $\mathbf{36}_2, \ldots, \mathbf{36}_i$ for individual compression of the corresponding band pass filtered signal derivatives $\mathbf{26}_1, \mathbf{26}_2, \ldots, \mathbf{26}_i$. FIG. 4 illustrates the compressor and offset amplifiers $\mathbf{38}_1, \mathbf{38}_2, \ldots, \mathbf{38}_i$ in the respective frequency bands $\mathbf{36}_1, \mathbf{36}_2, \ldots, \mathbf{36}_i$, having compressor characteristics in accordance with the present invention. The illustrated compressor characteristics $\mathbf{38}_1$ and $\mathbf{38}_2$ correspond to the characteristic shown in FIG. 2. In the present example, $\mathbf{36}_1$ and $\mathbf{36}_2$ are low frequency band pass filters, e.g. with pass bands below 500 Hz. $\mathbf{36}_1$, may have a pass band below 300 Hz and $\mathbf{36}_2$ may have a pass band between 300 Hz and 500 Hz. For simplicity, compressors are not illustrated in every frequency band. Compressors with characteristics in accordance with the present invention may be included in any appropriate frequency channel.

I claim:

1. A method of processing a sound signal in a hearing aid, comprising the steps of converting an acoustic signal into an electric signal, feeding said electric signal into a signal processor and filtering, inside said processor, set electrical signal in a set of band pass filters to produce band pass filtered signal derivatives, compressing said band pass filtered signal derivatives in respective compressors connected to respective band pass filters to produce compressed signals, processing said compressed signals in said signal processor in order to produce a processor output signal suitable for compensating a users hearing deficiency, and converting the processor output signal into a sound signal, wherein each of said compressors compresses the signals according to a compression characteristic with attack time above 0.5 seconds, the compression characteristic having a first and a second segment, the first and the second segment being connected at a knee point at an output level below a hearing threshold, the first segment being situated below the knee point and having substantially no compression, and the second segment being situated above the knee point and having a compression ratio greater than 1.4 to produce a compressed signal.

2. The method according to claim 1, comprising processing the electric signals in a signal processor having more than 6 channels.

3. The method according to claim 1, comprising processing the electric signals in a signal processor having more than 10 channels.

* * * * *